US006120623A

United States Patent [19]

Gupta et al.

[11] Patent Number: 6,120,623

[45] Date of Patent: Sep. 19, 2000

[54] PROCESS OF PRODUCING ALUMINUM ALLOY SHEET EXHIBITING REDUCED ROPING EFFECTS

[75] Inventors: Alok Kumar Gupta, Kingston; David James Lloyd, Bath, both of Canada; Michael Jackson Bull, Brighton, Mich.; Pierre H. Marois, Kingston; Daniel Ronald Evans, Bath, both of Canada

[73] Assignee: Alcan International Limited, Montreal, Canada

[21] Appl. No.: 09/024,849

[22] Filed: Feb. 17, 1998

Related U.S. Application Data

[60] Provisional application No. 60/038,438, Feb. 19, 1997.

[51] Int. Cl.[7] ..... C22F 1/04

[52] U.S. Cl. ..... 148/552; 148/693; 148/417; 420/546

[58] Field of Search ..... 148/552, 692, 148/693, 417; 420/546

[56] References Cited

U.S. PATENT DOCUMENTS

| | | | |
|---|---|---|---|
| 4,652,314 | 3/1987 | Meyer | 148/552 |
| 4,897,124 | 1/1990 | Matsuo et al. . | |
| 5,192,378 | 3/1993 | Doherty et al. | 148/691 |
| 5,266,130 | 11/1993 | Uchida et al. . | |
| 5,480,498 | 1/1996 | Beudoin et al. . | |
| 5,616,189 | 4/1997 | Jin et al. | 148/549 |

FOREIGN PATENT DOCUMENTS

WO 96/03531 2/1996 WIPO .

*Primary Examiner*—John Sheehan
*Assistant Examiner*—Andrew L. Oltmans
*Attorney, Agent, or Firm*—Cooper & Dunham LLP

[57] ABSTRACT

A process of producing an aluminum alloy sheet product suitable for forming into automotive parts and exhibiting reduced roping effects. The process involves producing an aluminum alloy sheet product by direct chill casting an aluminum alloy to form a cast ingot, homogenizing the ingot, hot rolling the ingot to form and intermediate gauge product, cold rolling the intermediate gauge product to form a product of final gauge, and subjecting the final gauge product to a solutionizing treatment by heating the product to a solutionizing temperature, followed by a pre-aging step involving cooling the product to a coiling temperature above 50° C., coiling the cooled product at the coiling temperature, and cooling the coiled final gauge product from the coiling temperature above 50° C. to ambient temperature at a rate less than about 10° C. per hour to improve T8X temper characteristics of the product. Additionally, a batch anneal step is carried out on the intermediate gauge product or at an intermediate stage of the cold rolling to reduce or eliminate roping tendencies of the alloy sheet product. To maintain a high T8X response, the alloy used in the process has the following composition: 0.4 to 1.1% by weight magnesium; 0.3 to 1.4% by weight silicon; 0 to 1.0% by weight copper; 0 to 0.4% by weight iron; 0 to 0.15% by weight manganese; 0 to 0.15% weight naturally-occurring impurities (collective total); and the balance aluminum. The invention also relates to a sheet alloy product exhibiting reduced roping effects produced by the indicated process.

14 Claims, 3 Drawing Sheets

PROCESS OF PRODUCING ALUMINUM ALLOY SHEET EXHIBITING REDUCED ROPING EFFECTS

CROSS-REFERENCE TO RELATED APPLICATIONS

This application claims the benefit of U.S. Provisional Application No. 60/038,438, filed Feb. 19, 1997.

BACKGROUND OF THE INVENTION

I. Field of the Invention

This invention relates to a process of producing aluminum alloy sheet products having properties suitable for use in fabricating automotive parts. More particularly, the invention relates to the production of aluminum alloy sheet products suitable for fabricating automotive parts that are visible in the finished vehicles, such as automotive skin panels and the like.

II. Description of the Prior Art

The automotive industry, in order to reduce the weight of automobiles, has increasingly substituted aluminum alloy panels for steel panels. Lighter weight panels, of course, help to reduce automobile weight, which reduces fuel consumption, but the introduction of aluminum alloy panels creates its own set of needs. To be useful in automobile applications, an aluminum alloy sheet product must possess good forming characteristics in the as-received (by the auto manufacturer) T4 temper condition, so that it may be bent or shaped as desired without cracking, tearing or wrinkling. At the same time, the alloy panels, after painting and baking, must have sufficient strength to resist dents and withstand other impacts.

Several aluminum alloys of the AA (Aluminum Association) 2000 and 6000 series are usually considered for automotive panel applications. The AA6000 series alloys contain magnesium and silicon, both with and without copper but, depending upon the Cu content, may be classified as AA2000 series alloys. These alloys are formable in the T4 temper condition and become stronger after painting and baking (steps usually carried out on formed automotive parts by vehicle manufacturers). Good increases in strength after painting and baking are highly desirable so that thinner and therefore lighter panels may be employed.

To facilitate understanding, a brief explanation of the terminology used to describe alloy tempers may be in order at this stage. The temper referred to as T4 is well known (see, for example, Aluminum Standards and Data (1984), page 11, published by The Aluminum Association) and refers to alloy produced in the conventional manner, i.e. without intermediate batch annealing and pre-aging. This is the temper in which automotive sheet panels are normally delivered to parts manufacturers for forming into skin panels and the like. T8 temper designates an alloy that has been solution heat-treated, cold worked and then artificially aged. Artificial aging involves holding the alloy at elevated temperature(s) over a period of time. T8X temper refers to a T8 temper material that has been deformed in tension by 2% followed by a 30 minute treatment at 177° C. to represent the forming plus paint baking treatment typically experienced by formed automotive panels. An alloy that has only been solution heat-treated and artificially aged to peak strength is said to be in the T6 temper, whereas if the aging has taken place naturally under room temperature conditions, the alloy is said to be in the T4 temper, as indicated above. Material that has undergone an intermediate batch annealing, but no pre-aging, is said to have a T4A temper. Material that has undergone pre-aging but not intermediate batch annealing is said to have a T4P temper, and material that has undergone both intermediate annealing and pre-aging is said to have a T4PA temper.

In prior U.S. Pat. No. 5,616,189, issued on Apr. 1, 1997 to Jin et al., assigned to the same assignee as the present application (and also in equivalent PCT publication WO 96/03531 published on Feb. 8, 1996), a process of producing aluminum sheet of the 6000 series is described having T4 and T8X tempers that are desirable for the production of automotive parts. The process involves subjecting a sheet product, after cold rolling, to a solutionizing treatment (heating to 500 to 570° C.) followed by a quenching or cooling process involving carefully controlled cooling steps to bring about a degree of "pre-aging." This procedure results in the formation of fine stable precipitate clusters that promote a fine, well dispersed precipitate structure during the paint/bake procedure to which automotive panels are subjected, and consequently a relatively high T8X temper.

Unfortunately, sheet products produced in this way from direct chill (DC) cast ingots often suffer from a phenomenon known as roping, ridging or "paint brush" line formation (the term "roping" is used henceforth), i.e. the formation of narrow bands having a different crystallographic structure than the remaining metal resulting from the metal rolling operation and generally aligned in the direction of rolling. During subsequent transverse straining of the sheet products as they are being formed into automotive parts, these bands manifest themselves as visible surface undulations, which detract from the final surface finish of the automotive product.

Roping has been encountered by others in this art, and it has been found that roping may be inhibited by modifying the sheet production method so that recrystallisation occurs at an intermediate stage of processing. The inhibition of roping is addressed, for example, in U.S. Pat. No. 5,480,498 issued on Jan. 2, 1996 to Armand J. Beaudoin, et al., assigned to Reynolds Metals Company, and also in U.S. Pat. No. 4,897,124 issued on Jan. 30, 1990 to Matsuo et al., assigned to Sky Aluminum Co., Ltd. In these patents, roping is controlled by introducing a batch annealing step (e.g. heating at a temperature within the range of 316 to 538° C.) at an intermediate stage of the sheet product formation, e.g. after hot rolling but before cold rolling, or after an early stage of cold rolling.

However, it has been found that, if an intermediate batch anneal of this kind is carried out on sheet made of 6000 series aluminum alloy, there is a reduction not only of the T4 temper, but also of the T8X temper when the alloy is subjected to the solutionizing treatment/controlled cooling steps of our prior patent application. Therefore, attempts to control or prevent roping reduce or eliminate the benefits of the favourable T4/T8X temper characteristics that are otherwise achievable for these types of alloys.

There is consequently a need for an improved process of producing aluminum automotive alloy sheet products that exhibit little or no roping while maintaining desirable T4/T8X characteristics.

SUMMARY OF THE INVENTION

An object of the present invention is to provide an aluminum automotive alloy sheet product having little or no tendency to exhibit roping while having T4 and T8X characteristics that are acceptable for the production of automotive parts.

Another object of the invention is to overcome or reduce the adverse effect caused by carrying out a step for reducing roping in aluminum automotive alloy sheet products on the T4/T8X characteristics of the product.

Another object of the invention is to maintain good T4/T8X characteristics obtainable by solutionizing treatment/controlled quench, while reducing roping in the resulting product.

According to one aspect of the invention there is provided a process of producing an aluminum alloy sheet product suitable for forming into automotive parts exhibiting reduced roping effects, which comprises: producing an aluminum alloy sheet product by direct chill casting an aluminum alloy to form a cast ingot; homogenizing the ingot; hot rolling the ingot to form and intermediate gauge product; cold rolling the intermediate gauge product to form a product of final gauge; subjecting the final gauge product to a solutionizing treatment by heating the product to a solutionizing temperature, followed by a pre-aging step involving cooling the product to a coiling temperature above 50° C., coiling the cooled product at the coiling temperature, and cooling the coiled final gauge product from said coiling temperature above 50° C. to ambient temperature at a rate less than about 10° C. per hour to improve T8X temper characteristics of the product; wherein a batch anneal step is carried out on the intermediate gauge product or at an intermediate stage of said cold rolling to reduce or eliminate roping tendencies of the alloy sheet product; and wherein the aluminum alloy used in said process has a composition as shown below:

| | |
|---|---|
| Magnesium | 0.4 to 1.1% by weight |
| Silicon | 0.3 to 1.4% by weight |
| Copper | 0 to 1.0% by weight |
| Iron | 0 to 0.4% by weight |
| Manganese | 0 to 0.15% by weight |
| Naturally-occurring Impurities | 0 to 0.15% weight (collective total) |
| Aluminum | balance. |

The invention also relates to an equivalent process starting with direct chill cast alloy of the indicated composition produced in a separate step.

The invention further relates to alloy sheet products exhibiting reduced roping effects produced by the process of the invention.

The preferred range for the Mn content in the alloy used in the invention is 0.07% to 0.15% by weight, more preferably 0.07% to 0.10% by weight, and the preferred range for the Fe content is 0.1% to 0.4% by weight.

The naturally-occurring impurities that may be present 25 include, for example, Zn, Cr, Ti, Zr and V, and the upper limit of each such impurity is normally about 0.05% by weight with the cumulative total of such impurities being up to 0.15% by weight. Ideally, the combined amount of such impurities plus the Mn (e.g. Mn+Zr+Cr) is less than 0.15% by weight. More information about naturally-occurring impurities in such alloys can be obtained from: "Registration Record of International Alloy Designations and Chemical Composition Limits for Wrought Aluminum and Wrought Aluminum Alloys;" The Aluminum Association, 900 19th Street N. W., Washington, D.C. 20006; Revised June 1994 (the disclosure of which is incorporated herein by reference).

Aluminum alloy of the composition given above is similar to alloy AA6111 but differs in that it contains less manganese (Mn). The Aluminum Association specification for alloy AA6111 requires the presence of 0.15 to 0.45% by weight of Mn, whereas (as noted above) the alloy of the invention contains less than this, and preferably less than 0.10% by weight of Mn, and ideally about 0.07% by weight of Mn.

While no copper need be present in the conventional 6000 series alloys, copper preferably should be present (in an amount up to 1.0% by weight) in the alloy used in the present invention since the cooling (quench) conditions need not be so closely controlled when copper is present, thus making the process more suitable for commercialization; but alloys without copper are also acceptable.

The alloy used in the present invention may undergo an intermediate batch anneal to eliminate roping tendencies, while at the same time maintaining the generally higher paint bake response achieved by using a controlled step quenching process of the type described above.

Panels formed from the material of this invention do not show significant roping and yet acquire higher strength during the paint bake than conventional AA6111 alloy sheet treated in the same way.

DETAILED DESCRIPTION OF THE INVENTION

Figure 1:
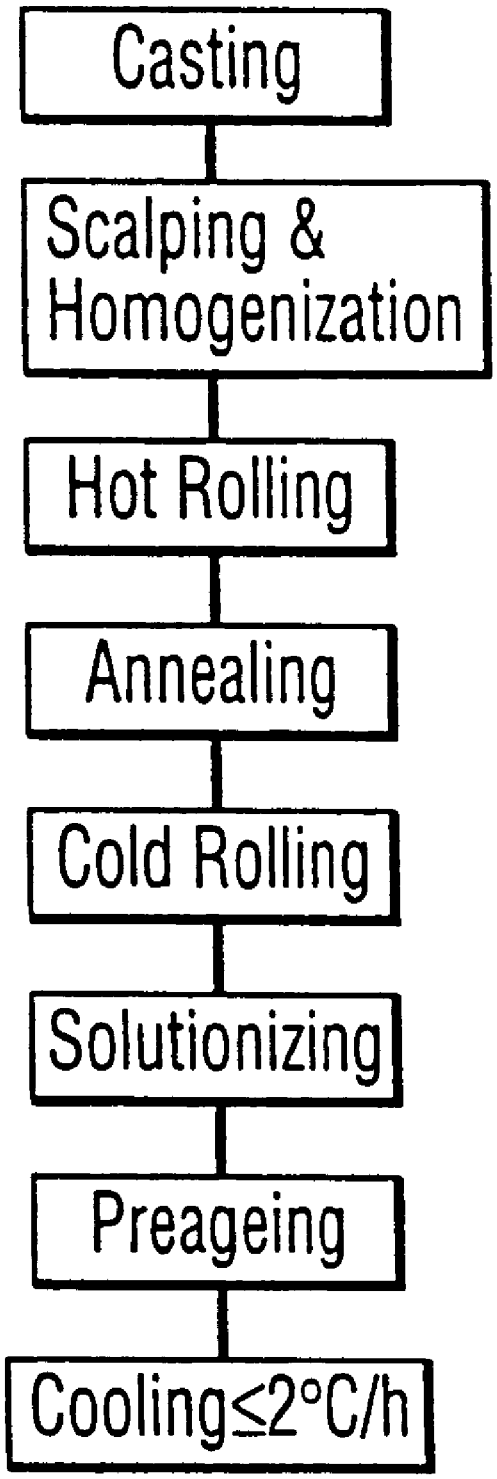
FIG. 1 is a schematic diagram showing one preferred example of the process of the present invention in which the batch anneal ("annealing" in the diagram) is carried out between hot and cold rolling; as an alternative, the batch anneal may be carried out between multiple passes of the cold rolling step.

As noted above, the present invention relates to the use of particular aluminum alloys in a process of producing aluminum automotive sheet products involving both an intermediate batch anneal and controlled pre-aging step.

Many of the process steps carried out in the present invention are described in detail in our prior U.S. Pat. No. 5,616,189 mentioned above, and the disclosure of this patent is incorporated herein by reference. Moreover, a batch annealing process is described in U.S. Pat. No. 5,480,498 and the disclosure of this patent is also incorporated herein by reference.

The alloy used for the invention (having a composition as defined above) is first cast by a direct chill (DC) method. The resulting DC cast ingot is preferably scalped and homogenized (e.g. by maintaining it at a temperature between about 480 and 580° C. for less than 48 hours), and is then hot rolled or hot and partially cold rolled to an intermediate gauge. The intermediate gauge product is subjected to a batch annealing step by maintaining it at a temperature between about 350 and 500° C. for less than 48 hours, preferably 1 hour at 400° C., and is then cold rolled to final gauge and solutionized, preferably in a continuous furnace at a temperature in the range of 480 to 580° C. for a period of time that is often less than one minute. In order to obtain desirable eventual T8X temper properties after forming, painting and baking, the solutionized sheet article is subjected to pre-aging. This involves cooling the sheet article from the solutionizing temperature, coiling the sheet article at a temperature in the range of 55 to 85° C., and then cooling the coiled sheet article slowly at a temperature of 10° C. per hour or less, more preferably at a rate of 2° C. per hour or less from the coiling temperature. The cooling from the solutionizing temperature prior to coiling may involve rapid quenching by means of water cooling, water mist cooling or forced air cooling.

Preferably, the cooling may be carried out by a special procedure involving cooling the sheet article from the solutionizing treatment temperature to the coiling temperature, coiling the sheet article, and then further cooling to ambient temperature at a significantly slower rate within the range mentioned above. In such a procedure, the cooling to the coiling temperature may be achieved in a single step or in multiple steps.

A preferred quenching process of this type involves four cooling phases or sequences: first, from the solutionizing treatment temperature to a temperature between about 350° C. and about 220° C. at a rate faster than 10° C./second, but no more than 2000° C./second; second, the alloy sheet is cooled from about 350° C. to about 220° C. to between about 270° C. and about 140° C. at a rate greater than about 1° C. but less than about 50° C./second; third, further cooling to between about 120° C. and the coiling temperature at a rate greater than 5° C./minute but less than 20° C./second; coiling the sheet article at the coiling temperature; and then fourth, cooling the coiled sheet article as indicated above, i.e. from between about 85° C. and about 50° C. to ambient temperature at a rate less than about 10° C./hour, and more preferably less than about 2° C./hour.

The coiled material is then normally subjected to various finishing operations, including cleaning, applying a lubricant and, on occasion, pre-treatment prior to lubricating, levelling to obtain a flat sheet for forming into parts, and cutting to produce sheet of the desired length. Such finishing operations are well known in this art and are therefore not described in detail in this disclosure.

As already noted, the conventional 6000 series sheet materials used for automotive skin parts contain Cu, Mg, Si, Fe and Mn as the major alloying elements. The composition of the conventional AA6111 alloy used for this purpose is summarized in Table 1. Also shown for comparison are examples, designated alloys X626 and X627, of the alloys used in the present invention.

TABLE 1

Nominal Compositions (% by weight) of AA6111 alloy and X626 and X627 example alloys in the present invention

| Alloy | Alloy Type | Cu | Mg | Si | Fe | Mn | Cr |
|---|---|---|---|---|---|---|---|
| AA6111 | Conventional | 0.75 | 0.75 | 0.65 | 0.24 | 0.20 | 0.06 |
| AA6111 | | 0.76 | 0.75 | 0.62 | 0.24 | 0.20 | 0.006 |
| X626 | Examples of | 0.50 | 1.0 | 0.50 | 0.22 | 0.07 | <0.005 |
| X627 | the invention | 0.80 | 0.40 | 1.0 | 0.22 | 0.07 | <0.005 |

Cu, Mg and Si are used in the 6000 series alloys to improve the age-hardening response, while Fe, Mn and Cr are used to control the recrystallized grain size of the sheet material. Alloy AA6111 sheet in the T4 temper is conventionally fabricated from a large commercial size ingot which is homogenized at 560° C. for 4 to 16 hours, hot rolled to 2.54 mm gauge and coiled between 300 and 330° C. The hot rolled material is then cold rolled to the final gauge of 0.93 mm, solutionized in a continuous annealing line between 480° C. to 580° C., preferably about 550° C., rapidly cooled to room temperature and naturally aged for more than 48 hours. The material in T4P is produced in the same way, but it is rapidly cooled after the solutionizing treatment to a temperature between 65 and 75° C. and then cooled to room temperature at a rate less than 2° C./hour. The T4A and T4PA temper sheets are produced in the same way as the T4 and T4P temper sheets, respectively, except the sheets are subjected to an interanneal for 1 hour at 400° C. before cold rolling to the final gauge of 1.0 mm.

Table 2 below summarizes the properties of the AA6111 alloy commercially produced in the T4, T4P, T4A and T4PA tempers. It can be seen from Table 2 that the tensile properties of the T4 and T4P tempers are quite similar, except in the paint bake temper (simulated by a 2% stretch plus a 30 minute hold at 177° C.). The paint bake response of the T4P material is about 18% better than the T4 temper material. Both material exhibited roping, while the T4A and T4PA do not.

TABLE 2

Mechanical Properties of Conventionally Produced AA6111 Alloys in Different Tempers

| | AA6111 Temper Designations | | | |
|---|---|---|---|---|
| | Conventional | | Roping Reduced | |
| Properties | T4 | T4P | T4A | T4PA |
| As Received | | | | |
| YS[1] (MPa) | 146.1 | 149.3 | 128.7 | 131.0 |
| UTS[2] (MPa) | 285.3 | 288.2 | 262.7 | 258.6 |
| % EI[3] | 26 | 25 | 23 | 25 |
| n[4] | 0.27 | 0.26 | 0.28 | 0.27 |
| Min Bend ratio, r/t | | | | |
| L[5] | 0.44 | 0.44 | 0.44 | 0.49 |
| T[6] | 0.44 | 0.55 | 0.33 | 0.39 |
| Grain Size, μm (L*T) | 31*14 | 34*14 | 32*17 | 23*19 |
| Erichsen Ht, mm | 9.0 | — | — | 8.3 |
| Paint Bake Temper (2% stretch + ½ h @ 177° C.) | | | | |
| YS (MPa) | 224.8 | 266.0 | 212.6 | 234.9 |
| UTS (MPa) | 288.2 | 340.3 | 292.6 | 311.6 |
| % EI | 22 | 20 | 21.7 | 20.5 |

TABLE 2-continued

Mechanical Properties of Conventionally Produced AA6111 Alloys in Different Tempers

| | AA6111 Temper Designations | | | |
|---|---|---|---|---|
| | Conventional | | Roping Reduced | |
| Properties | T4 | T4P | T4A | T4PA |

Notes:
[1]Yield Strength
[2]Ultimate Tensile Strength
[3]Percentage Total Elongation
[4]Strain Hardening Index
[5]Longitudinal Direction
[6]Transverse Direction The batch annealing step causes the precipitation of coarse $Mg_2Si/Si$ particles that cannot be redissolved completely during the solutionizing treatment. As a result, the batch annealed material does not acquire the strength levels of the T4 temper material (as can be seen from a comparison of the properties of the AA6111-T4 and AA6111-T4A materials in Table 2). The adverse effect of the batch annealing is, however, more dramatic in the properties of the pre-aged products. The paint bake response of the AA6111-T4PA product is much lower than that of the AA6111-T4P material. It is clear that conventional alloys, fabricated by a process including an intermediate batch anneal carried out to reduce roping in the final product, do not show an improvement in the paint bake response as exhibited by conventional alloy. That is to say, the intermediate batch anneal reduces the ability of the alloy sheet product to demonstrate significant paint bake response. This is the case even if conventional 6000 series alloys are subjected to a pre-age step during the fabrication process, despite the fact that such a pre-age step significantly improves the paint bake response. The choice available for the conventional alloys therefore appears to be a non-roping product with unsatisfactory paint bake response, or a product having a good paint bake response that exhibits unsatisfactory roping in the final product.

Surprisingly, the inventors of the present invention have found that, when an intermediate batch anneal is carried out, the benefit of preaging can be restored to a significant extent by using a starting alloy having a reduced amount of Mn compared with the conventional 6000 series alloys. In a preferred alloy employed in the invention, the amount of (Mn+Zr+Cr) is made less than 0.15% by weight. Without wishing to be bound to any particular theory, it is theorized that the Mn/Cr in the conventional alloys combines with the Cu and Si to form dispersoids and thereby depletes the matrix of hardening solutes. It is believed that this has the effect of slightly reducing the aging response of the alloy. If this is correct, it suggests that a reduction of the dispersoid forming element such as Mn would allow an alloy to have better aging response. It should be noted, however, that this effect alone is not sufficient to explain the entire improvement of the paint bake response achieve by using the special Mn-reduced alloys of the invention. That is to say, while the reduction of Mn might be expected to improve the paint bake response of an alloy if the above theory is correct, the degree of improvement of the paint bake response in the present invention would not be expected. At this time, for alloys that have undergone an intermediate anneal to reduce roping effects, it is not clear why the reduction of Mn has the effect of restoring most of the improved paint bake response produced by the preaging process.

The advantageous effect of the alloys used in the present invention will be appreciated from the results of experiments carried out on a conventional Cr-free AA6111 alloy and two Mn-reduced alloys, as indicated in the following Example, which should not however be regarded as limiting the scope of the present invention in any way.

EXAMPLE

Samples of AA6111, X626 and X627 alloys were fabricated in sheet product having T4P and T4PA tempers. The alloys were cast as commercial sized ingots, scalped, homogenized at 560° C. for 4 to 16 hours, hot rolled to an intermediate gauge of 2.54 mm and coiled between 300 and 330° C. One coil of each alloy was interannealed for about 1 hour at 400° C. before rolling to the final gauge of 0.98 mm. The other hot rolled coils were cold rolled to the final gauge without being subjected to an interanneal step. The final gauge cold rolled materials were solutionized at 560° C. in a continuous annealing line, rapidly cooled to between 65 and 75° C. and then cooled further to room temperature at a rate less than 2° C./h. FIG. 1 of the accompanying drawings shows a schematic diagram of the overall processing route of this invention.

Figure 2A:
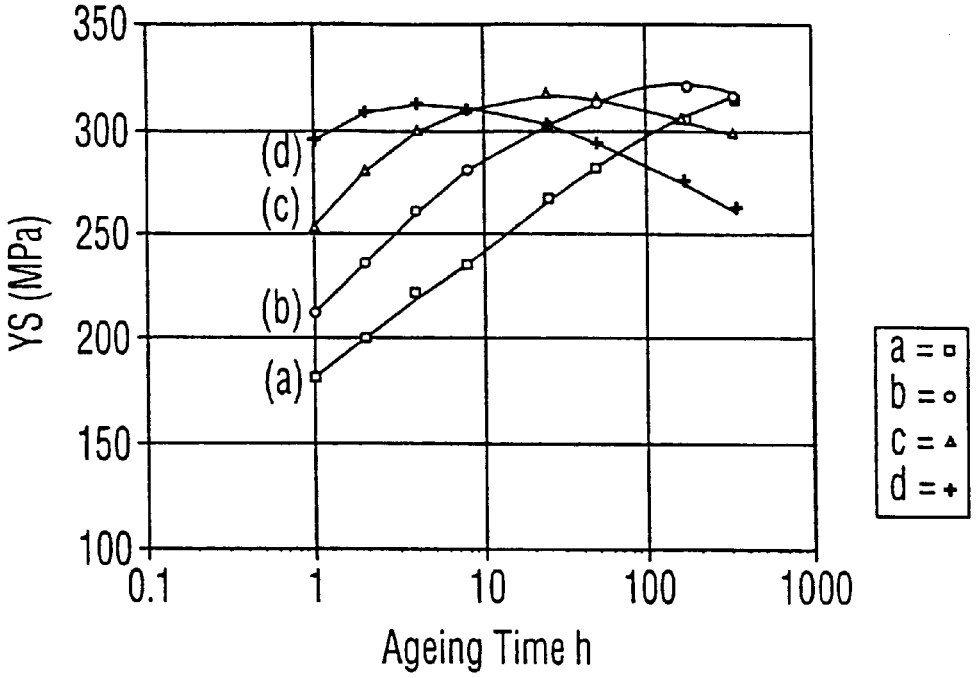
FIG. 2A is a graph showing aging curves to T6 tempers at different temperatures for conventional AA6111 alloy produced without an intermediate batch annealing step, but with pre-aging—curves (a), (b), (c) and (d) show pre-aging at 140° C., 160° C., 180° C. and 200° C., respectively.
Figure 2B:
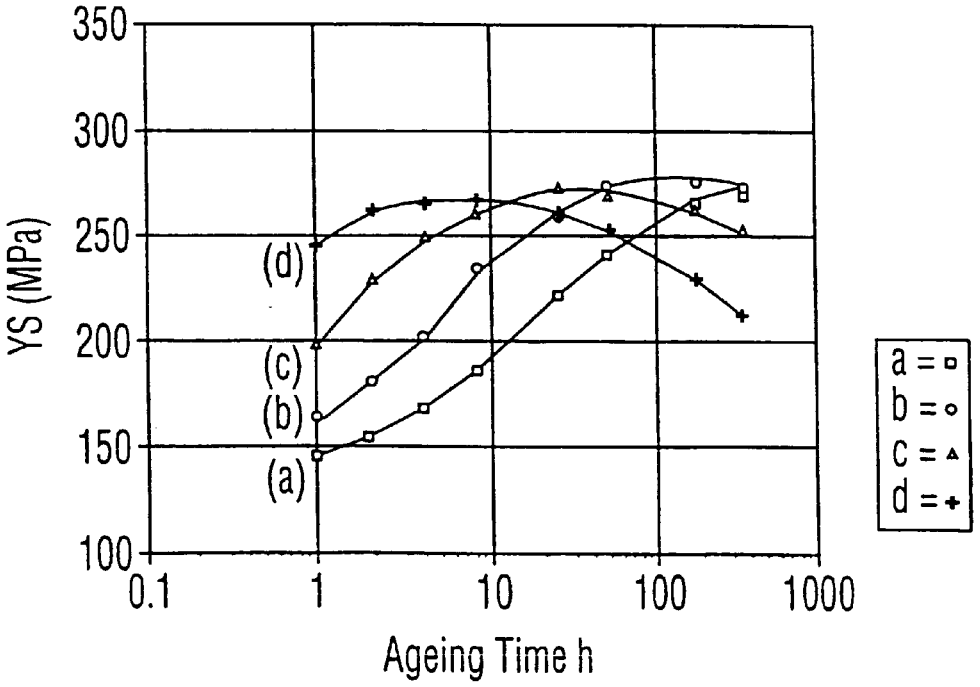
FIG. 2B is a graph showing aging curves at different temperatures for conventional AA6111 alloy produced with an intermediate batch anneal to reduce roping effects and pre-aging—the curves show the same aging temperatures as in FIG. 2A.
Figure 3A:
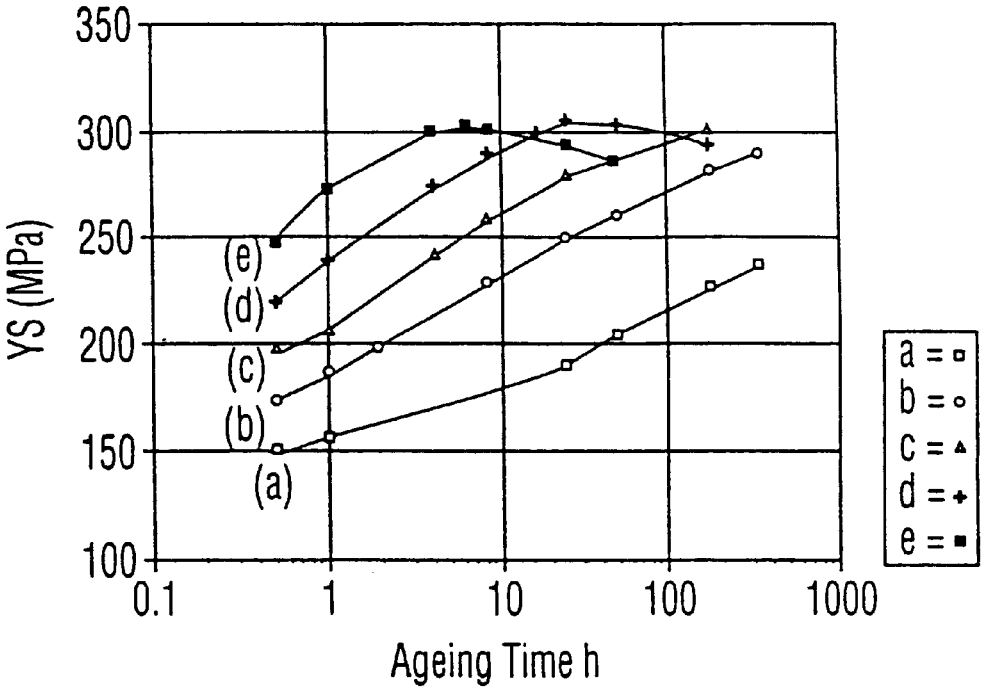
FIG. 3A is a graph showing aging curves at different temperatures for an alloy having a composition required for the present invention (alloy X626) without intermediate batch annealing but with pre-aging—in this case, curves (a), (b), (c), (d) and (e) show pre-aging at temperatures of 100° C., 140° C., 160° C., 180° C. and 200° C., respectively.
Figure 3B:
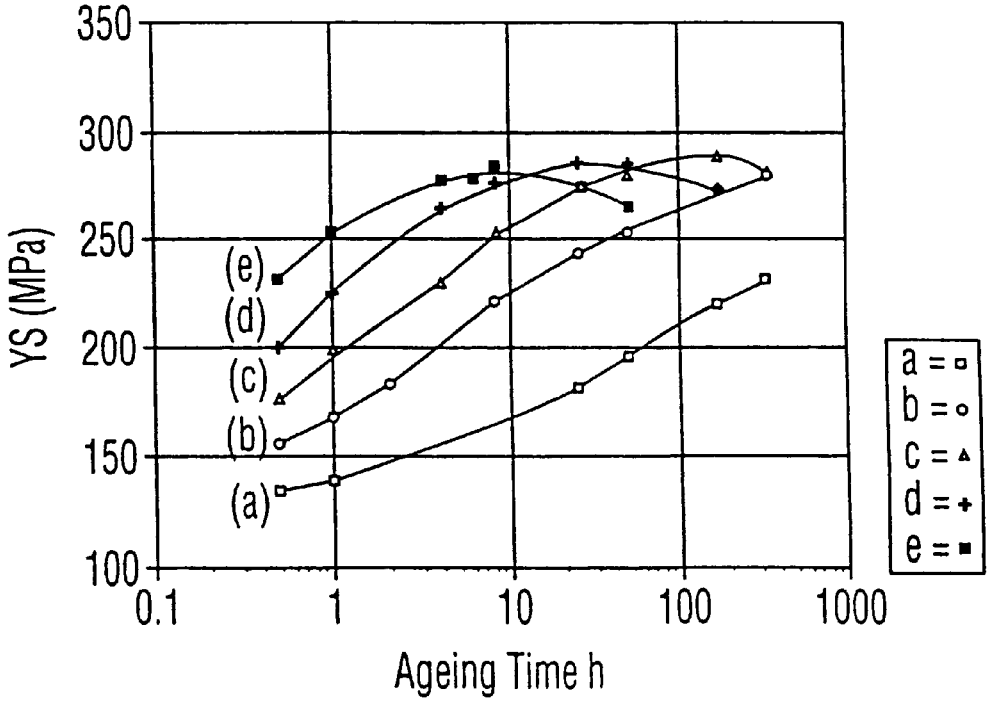
FIG. 3B is a graph showing aging curves at different temperatures for alloy X626 subjected to an intermediate batch annealing and pre-aging—the curves show the same aging temperatures as in FIG. 3A.

The AA6111 and X626 sheet products produced by T4P and T4PA tempers were subjected to an elevated temperature aging for various times and at various temperatures and the results are shown in FIGS. 2A, 2B, 3A and 3B of the accompanying drawings. The graphs shown in these Figures plot the yield strength of alloys against time. In the graphs of FIGS. 2A and 2B, the square plots indicate aging at 140° C., the circular plots indicate 160° C., the triangular plots indicate 180° C. and the diamond shaped plots indicate 200° C. In the graphs of FIGS. 3A and 3B, the square plots indicate aging at 100° C., the circular plots indicate 140° C., the triangular plots indicate 160° C., the diamond shaped plots indicate 180° C., and the phantom square plots indicate 200° C.

Table 3 below summarizes the results of the test performed on the AA6111, X626 and X627 alloys whose composition is shown in Table 1. It can be seen from the Table 3 that the tensile properties of the AA6111 material in T4P and T4PA tempers are significantly different from each other. Such a difference is much less in the Mn-free X626 and X627 alloys, especially in the paint bake temper. Similar results are obtained from the aging curves of AA6111 materials in FIGS. 2A and 2B. The T6 temper properties shown in these Figs. is interesting since it predicts the maximum strength that can be realized from the thermal component of the T8X response (the T8X response has both a strain component—simulated by the 2% stretch—and a thermal component). The peak strength of the batch annealed AA6111 material is about 50 MPa lower than that of the T4P product. The batch annealed X626 alloys also shows lower peak strength but the extent of the loss is much less, i.e. about 20 MPa. The loss of peak strength is believed to be primarily due to the presence of the coarse $Mg_2Si/Si$ particles that were not dissolved during the solutionizing treatment on a continuous annealing line.

It should be noted that the yield strength values of AA6111 in the T4P and T4PA tempers in Table 3 are different from those in Table 2. These differences are primarily due to the differences in the solutionizing, batch annealing and natural aging conditions. It is however worth noting the yield strength of the AA6111, X626 and X627 alloys (Table 1) were subjected to similar fabrication practice. The observed differences in the paint bake properties of the T4P and T4PA materials are due to the presence or absence of Mn in the example alloys. The removal of Mn reduces the grain aspect ratio and grain will become slightly coarser. Fortunately, the inclusion of the batch annealing in the fabrication process refines the grain size and makes addition of Mn to the alloy redundant.

TABLE 3

Mechanical Properties of AA6111, X626 and X627 Alloys in the T4P and T4PA Tempers

| | Internal Alloy and Temper Designations | | | | | |
|---|---|---|---|---|---|---|
| | Conventional T4P Temper | | | Roping Reduced T4PA Temper | | |
| Properties | AA6111 | X626 | X627 | AA6111 | X626 | X627 |
| As Received | | | | | | |
| YS (MPa) | 137 | 129 | 132 | 107 | 133 | 136 |
| UTS (MPa) | 273 | 252 | 264 | 234 | 258 | 269 |
| % EI | — | 25 | 26 | 27 | 26 | 28 |
| n | 0.26 | 0.27 | 0.27 | 0.3 | 0.29 | 0.29 |
| Min Bend ratio, r/t | | | | | | |
| L | 0.30 | 0 | 0 | 0.3 | 0.3 | 0.5 |
| T | 0.30 | 0.16 | 0.16 | 0.3 | 0.3 | 0.3 |
| Grain Size, $\mu$m | | | | | | |
| (L*T) | 39*17 | 47*30 | 51*30 | 27*22 | 35*29 | 38*29 |
| Paint Bake Temper | | | | | | |
| (2% stretch + ½ h @ 177° C.) | | | | | | |
| YS (MPa) | 285 | 259 | 256 | 196 | 244 | 234 |
| UTS (MPa) | 352 | 324 | 320 | 279 | 312 | 309 |
| % EI | 17 | 18 | 20 | 19 | 18 | 22 |

What we claim is:

1. A process of producing an aluminum alloy sheet product suitable for forming into automotive parts exhibiting reduced roping effects, which comprises:

producing an aluminum alloy sheet product by direct chill casting an aluminum alloy to form a cast ingot;

homogenizing the ingot;

hot rolling the ingot to form and intermediate gauge product;

cold rolling the intermediate gauge product to form a product of final gauge;

subjecting the final gauge product to a solutionizing treatment by heating the product to a solutionizing temperature, followed by a pre-aging step involving cooling the product to a coiling temperature above 50° C., coiling the cooled product at the coiling temperature, and cooling the coiled final gauge product from said coiling temperature above 50° C. to ambient temperature at a rate less than about 10° C. per hour to improve T8X temper characteristics of the product;

wherein a batch anneal step is carried out on the intermediate gauge product or at an intermediate stage of said cold rolling to reduce or eliminate roping tendencies of the alloy sheet product; and.

wherein the aluminum alloy used in said process has a composition as shown below:

| | |
|---|---|
| Magnesium | 0.4 to 1.1% by weight |
| Silicon | 0.3 to 1.4% by weight |

-continued

| | |
|---|---|
| Copper | 0 to 1.0% by weight |
| Iron | 0 to 0.4% by weight |
| Manganese | 0 to 0.15% by weight |
| Naturally-occurring Impurities | 0 to 0.15% weight (collective total) |
| Aluminum | balance. |

2. The process of claim 1, wherein said cooling from said coiling temperature to ambient temperature is carried out at a rate of less than 2° C. per hour.

3. The process of claim 1, which comprises employing an alloy containing 0.07% to 0.15% Mn.

4. The process of claim 1, which comprises employing an alloy containing 0.07% to 0.10% Mn.

5. The process of claim 1, wherein said intermediate batch annealing step is carried out at a temperature between 350° C. and 500° C. for a time less than 48 hours.

6. The process of claim 1, wherein said intermediate batch annealing step is carried out at a temperature of about 400° C. for about 1 hour.

7. The process of claim 1, wherein said coiling temperature is within the range of 55 to 85° C.

8. The process of claim 1, wherein said product is cooled from said solutionizing temperature to said coiling temperature by quenching.

9. The process of claim 1, wherein said product is cooled from said solutionizing temperature to a first temperature between 350° C. and 220° C. at a rate faster than 10° C./second, but no more than 2000° C./second; the product is then cooled further to a second temperature between 270° C. and 140° C. at a rate greater than 1° C. but less than 50° C./second; and the product is further cooled to between 120° C. and said coiling temperature at a rate greater than 5° C./minute but less than 20° C./second.

10. The process of claim 1 wherein said solutionizing temperature is within the range of 480 to 580° C.

11. A process of producing an aluminum alloy sheet product suitable for forming into automotive parts exhibiting reduced roping effects from direct chill cast ingot, which comprises:

homogenizing said ingot;

hot rolling the ingot to form and intermediate gauge product;

cold rolling the intermediate gauge product to form a product of final gauge;

subjecting the final gauge product to a solutionizing treatment by heating the product to a solutionizing temperature, followed by a pre-aging step involving cooling the product to a coiling temperature above 50° C., coiling the cooled product at the coiling temperature, and cooling the coiled final gauge product from said coiling temperature above 50° C. to ambient temperature at a rate less than about 10° C. per hour to improve T8X temper characteristics of the product;

wherein a batch anneal step is carried out on the intermediate gauge product or at an intermediate stage of said cold rolling to reduce or eliminate roping tendencies of the alloy sheet product; and wherein the aluminum alloy used in said process has a composition as shown below:

| | |
|---|---|
| Magnesium | 0.4 to 1.1% by weight |
| Silicon | 0.3 to 1.4% by weight |
| Copper | 0 to 1.0% by weight |
| Iron | 0 to 0.4% by weight |
| Manganese | 0 to 0.15% by weight |
| Naturally-occurring Impurities | 0 to 0.15% weight (collective total) |
| Aluminum | balance. |

12. An aluminum alloy sheet product exhibiting little roping and having the following composition:

| | |
|---|---|
| Magnesium | 0.4 to 1.1% by weight |
| Silicon | 0.3 to 1.4% by weight |
| copper | 0 to 1.0% by weight |
| Iron | 0 to 0.4% by weight |
| Manganese | 0 to 0.15% by weight |
| Naturally-occurring Impurities | 0 to 0.15% weight (collective total) |
| Aluminum | balance; |

said product having been produced by a process comprising:

producing an aluminum alloy sheet product by direct chill casting an aluminum alloy of said composition to form a cast ingot;

homogenizing the ingot;

hot rolling the ingot to form and intermediate gauge product;

cold rolling the intermediate gauge product to form a product of final gauge;

subjecting the final gauge product to a solutionizing treatment by heating the product to a solutionizing temperature, followed by a pre-aging step involving cooling the product to a coiling temperature above 50° C., coiling the cooled product at the coiling temperature, and cooling the coiled final gauge product from said coiling temperature above 50° C. to ambient temperature at a rate less than about 10° C. per hour to improve T8X temper characteristics of the product;

wherein a batch anneal step is carried out on the intermediate gauge product or at an intermediate stage of said cold rolling to reduce or eliminate roping tendencies of the alloy sheet product.

13. The alloy of claim 12 containing 0.07% to 0.15% Mn.

14. The alloy of claim 12 which containing 0.07% to 0.10% Mn.

* * * * *